United States Patent [19]

Wilkinson

[11] Patent Number: 5,022,241

[45] Date of Patent: Jun. 11, 1991

[54] RESIDENTIAL HYBRID AIR CONDITIONING SYSTEM

[75] Inventor: William H. Wilkinson, Columbus, Ohio

[73] Assignee: Gas Research Institute, Chicago, Ill.

[21] Appl. No.: 519,116

[22] Filed: May 4, 1990

[51] Int. Cl.[5] ..... F25D 23/00

[52] U.S. Cl. ..... 62/271; 62/93; 62/476; 62/305; 62/311

[58] Field of Search ..... 62/271, 476, 93, 304, 62/311, 305

[56] References Cited

U.S. PATENT DOCUMENTS 4,204,409 5/1980 Satama ..... 62/271
4,488,408 12/1984 Kajitsuka ..... 62/277
4,759,195 7/1988 Biancardi ..... 62/283
4,905,479 3/1990 Wilkinson ..... 62/271
4,939,906 7/1990 Spag et al. ..... 62/271

*Primary Examiner*—Henry A. Bennett
*Assistant Examiner*—John Sollecito
*Attorney, Agent, or Firm*—Watkins, Dunbar & Pollick

[57] ABSTRACT

A residential-type hybrid air conditioning system having a conventional refrigeration subsystem which handles system sensible heat loads and a liquid desiccant dehumidification subsystem which handles system latent heat loads additionally incorporates an evaporative cooler which cooperates with and receives heat from the dehumidification subsystem to increase the performance efficiency of the total system.

4 Claims, 2 Drawing Sheets

RESIDENTIAL HYBRID AIR CONDITIONING SYSTEM

FIELD OF THE INVENTION

The present invention relates generally to air conditioning accomplished with a hybrid air conditioning system wherein sensible heat removal loads are handled with a conventional refrigeration subsystem, such as a vapor compression refrigeration subsystem or an absorption refrigeration subsystem, and wherein latent heat removal loads are cooperatively handled with a liquid desiccant dehumidification subsystem; the invention particularly concerns apparatus arrangements which utilize available cooling capacities from an added evaporative cooler component in a novel manner to thereby increase the performance efficiency of the total hybrid air conditioning system.

BACKGROUND OF THE INVENTION

Numerous known hybrid air conditioning systems utilize, in combination, a liquid desiccant dehumidification subsystem to handle system latent heat loads and a conventional refrigeration subsystem, vapor compression type or absorption type, to handle system sensible heat loads. In this regard see, for instance, U.S. Pat. No. 2,269,053 (Crawford), U.S. Pat. No. 2,355,828 (Taylor), U.S. Pat. No. 2,690,656 (Cummings), U.S. Pat. No. 3,102,399 (Meckler), U.S. Pat. No. 3,247,679 (Meckler), U.S. Pat. No. 4,259,849 (Griffiths), and U.S. Pat. No. 4,557,471 (Meckler).

U.S. Pat. No. 4,204,409 (Satoma) discloses use of direct evaporative cooling to supplement the cooling capacity of a vapor compression refrigeration air conditioning system and also interact with the vapor refrigeration subsystem condenser element.

A hybrid air conditioning system utilizing direct evaporative cooling to enhance total system performance efficiency also is described and claimed in my co-pending U.S. patent application Ser. No. 07/302,428, filed Jan. 27, 1989 and issued Mar. 6, 1990 as U.S. Pat. No. 4,905,479. In addition, an indirect evaporative cooling system combined with a liquid desiccant dehumidifier and intended to supplement, in a residential application, the cooling capacity of a conventional vapor compression refrigeration air conditioning system is marketed in the United States under the name "Kathabar" by the Midland-Ross Division of Combustion Engineering Corporation.

The above-identified prior art is the most relevant known to applicant regarding the hybrid air conditioning system described and claimed herein.

SUMMARY OF THE INVENTION

To achieve the objectives of the present invention I provide a multi-plate air-to-air heat exchanger and combined evaporative cooler assembly in cooperation with a building hybrid air conditioning system having a conventional refrigeration subsystem and a conventional liquid desiccant dehumidification subsystem. The refrigeration subsystem, which may be either a conventional vapor compression refrigeration subsystem with refrigerant condenser and evaporator elements or a conventional absorption refrigeration subsystem with desorber, condenser evaporator, and absorber elements, handles the building air conditioning sensible heat load; the liquid desiccant dehumidification subsystem handles the building air conditioning latent heat load. Sensible heat removal is accomplished normally by continuously recirculating the building air-conditioned air after dehumidification in heat exchange relation to the refrigeration subsystem evaporator element to effect air temperature changes. The recirculated air, along with any added or necessary make-up ventilation air, is preferably first dehumidified, however, by flow in mass transfer relation to the dehumidification subsystem liquid desiccant (usually a LiBr/water solution in spray form) to effect moisture removal or moisture content change and thereby achieve relative humidity control prior to cooling by refrigerant evaporation. The recirculated building air is flowed, concurrent with dehumidification, through the air-to-air heat exchanger in a heat transfer and non-mixing relation to evaporatively cooled exterior (atmospheric) air also flowed through the air-to-air heat exchanger. Such exterior air, which is external to the building enclosed air-conditioned space, is cooled indirectly by the evaporative cooler assembly which is normally located at the periphery of the building enclosed air-conditioned space. To further improve total system performance efficiency, an excess of water flowed to the included exterior evaporative cooler is also flowed in heat exchange relation to the recirculated air being dehumidified and optionally to the refrigeration subsystem condenser element (in the case of a vapor compression refrigeration subsystem) or to the refrigeration subsystem absorber element (in the case of an absorption refrigeration subsystem) to further recover available heat and improve the performance efficiency of the total system.

The foregoing and other advantages of the invention will become apparent from the following disclosure in which a preferred embodiment of the invention is described in detail and illustrated in the accompanying drawings. It is contemplated that variations in structural features and arrangement of parts may appear to the person skilled in the art, without departing from the scope or sacrificing any of the advantages of the invention.

DETAILED DESCRIPTION

Figure 1:
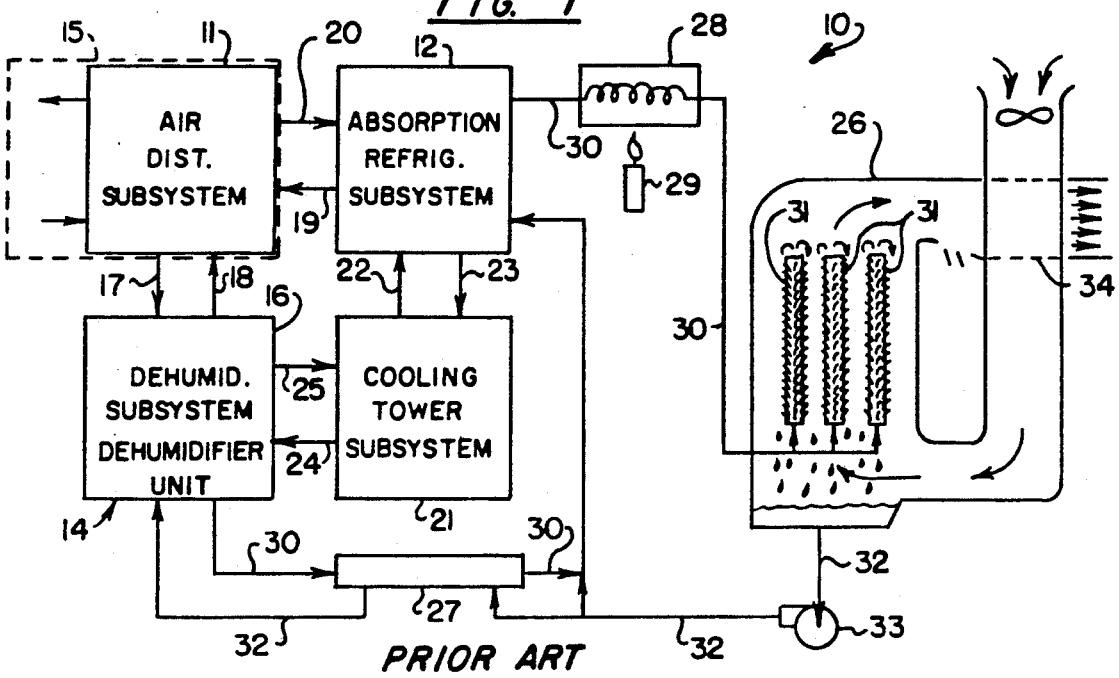
FIG. 1 is a functional block diagram and schematic illustration of a known type of hybrid air conditioning system.

By way of background information, FIG. 1 schematically illustrates a known hybrid type of building air conditioning system 10 which utilizes a conventional absorption refrigeration subsystem 12 in cooperative combination with a liquid desiccant dehumidification subsystem designated 14 to lower the relative humidity of and cool the air recirculated within a building enclosed space 15 by the building air distribution subsystem designated generally as 11. Subsystem 11 is conventional and is typically comprised of a blower installation, various louvered inlet and outlet openings in the air conditioned building enclosed space, and supply and return ductworks connecting the inlet and outlet openings to the blower installation.

Subsystem 14 has a dehumidifier unit 16 that normally dehumidifies both fractional make-up ventilation air received from the system ambient atmosphere and any controlled portion of the system recirculation air that is diverted from air distribution subsystem 11 through connecting duct 17 to achieve moisture content reduction. Such ventilation make-up air, after processing (dehumidification) in subsystem 14, is flowed by way of connecting duct 18 to subsystem 11 for mixing with the retained and recirculated system air and for cooling by a chilled water heat exchanger (not shown) functionally connected to absorption refrigeration subsystem 12 evaporator element by supply and return chilled water lines 19 and 20. Conventional cooling tower subsystem 21 cooperates with and cools the absorber heat exchanger element in refrigeration subsystem 12 through supply and return water circulation lines 22 and 23. Cooling tower subsystem 21 also cooperates with a heat exchanger element in the dehumidifier unit 16 of dehumidification subsystem 14 through supply and return water circulation lines 24 and 25.

Dehumidification subsystem 14 also has a liquid desiccant solution regenerator unit 26, heat exchangers 27, 28, optional auxiliary burner 29, and the various interconnecting lines which, in part, flow relatively dilute desiccant solution from unit 16 in heat exchange relation to the condenser element of refrigeration subsystem 12 prior to concentration in desiccant regenerator unit 26. Basically, dilute desiccant solution line elements 30 flow relatively dilute desiccant solution by operation of a pump (not shown) from the collection sump of the dehumidifier unit 16 of subsystem 14 to the exterior wetted surfaces of the desorber-like regenerator tubes 31 in regenerator assembly 26. Relatively concentrated desiccant solution is collected in the sump portion of regenerator assembly 26 and flowed to the dehumidifier unit 16 of subsystem 14 through line elements 32 by operation of circulation pump 33. Desiccant solution regenerator assembly 26 also includes an air-to-air recuperative heat exchanger 34.

A more-detailed description of the construction and operation of building hybrid air conditioning system 10 is provided in the herein referred to co-pending U.S. patent application Ser. No. 07/302,428 filed Jan. 27, 1989 and issued Mar. 6, 1190 as U.S. Pat. No. 4,905,479. However, a complete understanding of that system, although helpful, is not believed to be absolutely necessary for an understanding of the generally similar but different hybrid air conditioning system described and claimed in this application.

Figure 2:
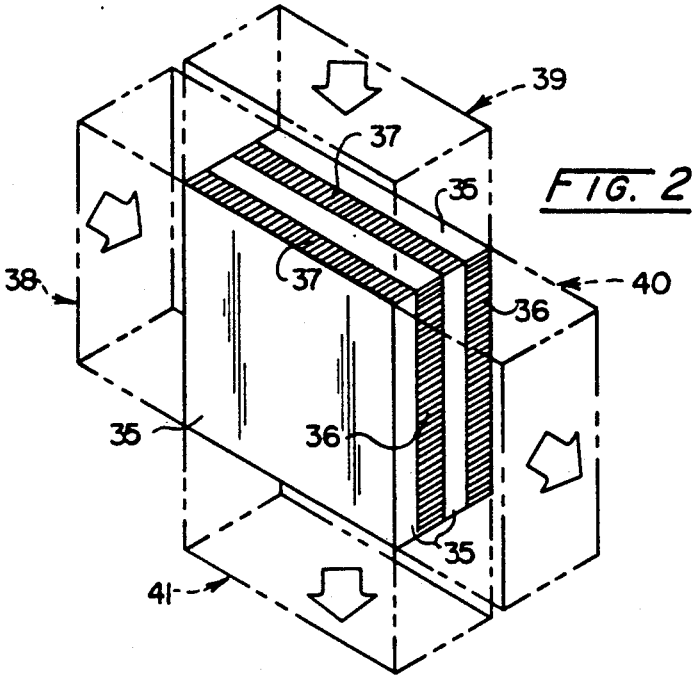
PRIOR ART FIG. 2
FIG. 2 is a perspective and schematic view of an air-to-air heat exchanger which may be advantageously used in the practice of this invention.

Also by way of background information, FIG. 2 schematically illustrates a preferred embodiment of an air-to-air heat exchanger assembly 34 utilized in the practice of this invention. Heat exchanger 34 is essentially comprised of multiple, spaced-apart metal heat transfer plates 35, alternately spaced side closure strips or members 36, and alternately spaced top and bottom closure strips/members 37. Such plates and closure strips are normally joined along their respective edges in an "air-tight" relation by appropriate soldering, welding, or other method of joinder. In addition, assembly 34 is comprised of inlet plenums 38 and 39 and outlet plenums 40 and 41 joined to the plate/strip combinations. Air flowed through plenum 38 to plenum 40 passes in heat transfer relation to plates 35 and to air flowed through plenum 39 to plenum 41.

Figure 3:
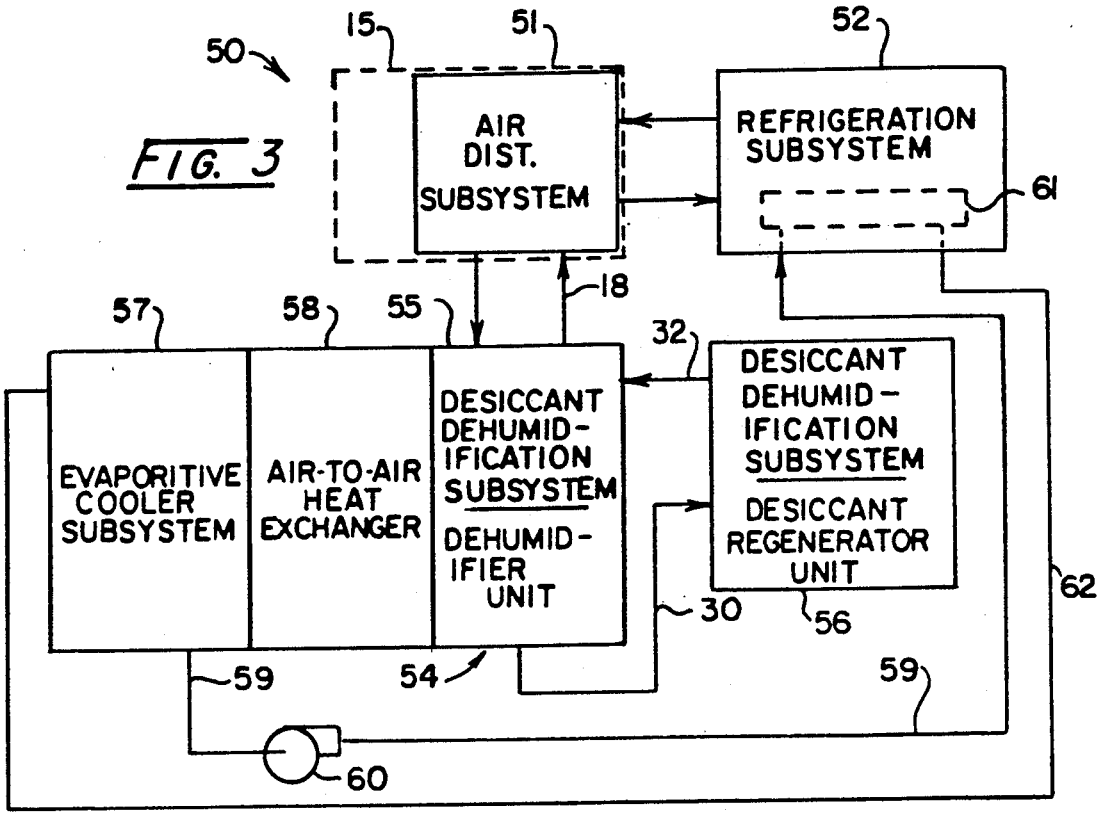
FIG. 3 is a functional block diagram and schematic illustration of one embodiment of the present invention.

A schematic illustration of the present invention, which significantly modifies the hybrid air conditioning system of FIG. 1, is detailed in FIG. 3 and is designated generally as system 50.

Such system includes an air distribution subsystem 51, a refrigeration subsystem 52, and a liquid desiccant dehumidification subsystem 54 that is basically comprised of dehumidifier unit 55 and desiccant regenerator unit 56. Such components essentially correspond to subsystem components 11, 12, 14, 16, and 26 of the FIG. 1 hybrid air-conditioning system. In addition, system 50 further includes a conventional evaporative cooler subsystem 57 which cooperates with dehumidifier unit 55 through the air-to-air heat exchanger assembly designated 58 in the drawings.

The air-to-air heat exchanger transfer heat from the desiccant dehumidification mass transfer process occurring on one side of the plate separating the two air flows to the water evaporation process on the other side of the plate. Water vapor in the recirculation air flow on the dehumidification side of the separating plate is absorbed in the desiccant solution spray that ends up as a falling film in contact with the heat exchanger separating plates. The heat released as the water vapor goes into the solution is transferred to the plates which are kept cold by the evaporation process occurring on the other plate side. The air passing over the plates on the evaporated, cooled side is primarily the transport means for removing the evaporated water vapor. Sensible heat gain my be improved on that air but it is secondary to the mass transport process.

In the FIG. 3 arrangement, an excess of water over that necessary to directly evaporatively cool the dehumidification energy flowing through heat exchanger 58 is collected in the sump of evaporative cooler subsystem 57 and flowed via line 59 and liquid pump 60 to a heat exchanger 61 provided in refrigeration subsystem 52. Heat exchanger 61 is arranged to be in heat transfer relation to the absorber element of conventional absorption refrigeration subsystem 52. The cooled water flowed through line 59 is heated in heat exchanger 61 and returned to the evaporative cooler subsystem 57 through line 62. When system 50 is operated in this mode, the extraction of refrigeration subsystem 52 reject (available) heat through heat exchanger 61 will result in simplification of the system in that the same ambient airflow removes both refrigeration subsystem reject heat and dehumidification reject heat.

Figure 4:
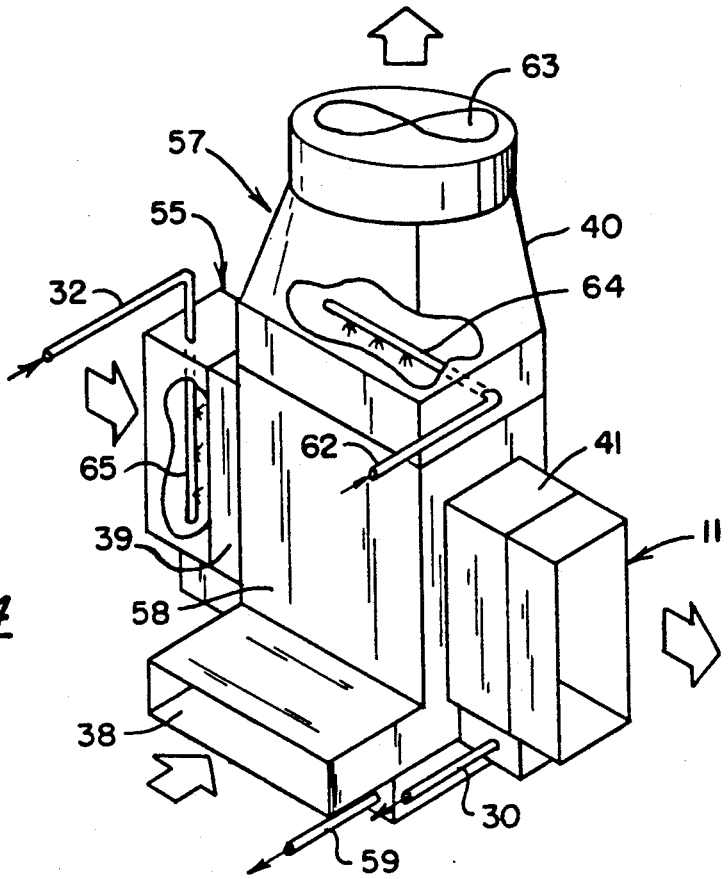
FIG. 4 is a perspective view of a key portion of an operating embodiment of the building air conditioning system illustrated in FIG. 3.

A practical arrangement of the FIG. 3 hybrid air conditioning system 50 components is illustrated in FIG. 4. Atmospheric air from outside the building air-conditioned space is drawn by fan 63 into plenum 38 and then into air-to-air heat exchanger 58 where evaporative cooling occurs. Water having been heated by the reject but from the refrigeration subsystem enters the evaporated cooler through line 62 and spray nozzles 64. The remaining liquid is cooled by this evaporation process and provides a thin liquid water film on the surface of the several plates 35 comprising air-to-air heat exchanger 58. The excess water flows by gravity to the sump at the bottom of air-to-air heat exchanger 58 and is collected and is recirculated to the refrigeration subsystem by line 59. Since this sump is in contrast with the outside air entering through plenum 38, the evaporative cooling of the dehumidification process will represent a close approach to the entering air's wet bulb temperature. The reject heat is transferred to the flow of ambient air leaving the air-to-air heat exchanger by the evaporation from the surface of the droplets created by the spray nozzles 64 and does not degrade the cooling of the dehumidification process occurring in the air-to-air heat exchanger 58. The air flows to plenum 40 from whence it is exhausted to the atmosphere by fan 63.

The dehumidification air flowed from unit 55 through heat exchanger 58 is exhausted from plenum 41 and flowed to air distribution subsystem 51 for its sensible cooling.

The dehumidification process is completed as the sprayed desiccant contacts the plates 35 of heat exchanger 58 where it is cooled as the thin, sprayed desiccant solution film flows over the plate surfaces in continued mass transfer relation with the air being dehumidified. The desiccant solution, after dilution by water removed from the to-be-cooled air, is collected in the sump of dehumidifier unit 55 and flowed through line 30 to the dehumidification subsystem regenerator unit 56 for reconcentration.

Although a preferred embodiment of the invention has been herein described, it will be understood that various changes and modifications in the illustrated described structure can be effected without departure from the basic principles of the invention. Changes and modification of this type are therefore deemed to be circumscribed by the spirit and scope of this invention defined by the appended claims or by a reasonable equivalence.

We claim:

1. A hybrid air conditioning system which handles the system combined sensible heat load and latent heat load associated with a building enclosed space, and which comprises:

a. a building air distribution subsystem which flows recirculated air from and to the building enclosed space and which provides the combined sensible heat load and latent heat load to the system;

b. a refrigeration subsystem having an evaporator element and receiving said air distribution subsystem recirculated air for the transfer of sensible heat to said evaporator element, c. a desiccant dehumidification subsystem having a dehumidifier unit and a desiccant regenerator unit cooperating with said dehumidifier unit through a flow of recirculated desiccant solution, receiving at least a portion of said air distribution subsystem recirculated air and any included make-up atmospheric air for the transfer of contained moisture to said desiccant solution by mass transfer with an attendant latent heat load, and receiving reject heat from said refrigeration subsystem for desiccant solution regeneration purposes;

d. an evaporative cooler subsystem receiving flows of cooling water and atmospheric air external to the building enclosed space; and e. air-to-air heat exchanger means cooperatively coupling said evaporative cooler subsystem to said desiccant dehumidification in heat transfer relation, and comprising an array of spaced-apart heat transfer plates, said air-to-air heat exchanger means transferring heat across said heat transfer plates from films of said desiccant solution to films of said cooling water with said evaporative cooler subsystem cooling water to the atmosphere external to said building enclosed space.

2. The hybrid air conditioning system defined by claim 1 wherein said refrigeration subsystem further has a vapor compression refrigeration cycle condenser element, and wherein reject heat is transferred from said refrigeration subsystem condenser element to said evaporative cooler subsystem flow of cooling water.

3. The hybrid air conditioning system defined by claim 1 wherein said refrigeration subsystem further has an absorption refrigeration cycle condenser element, and wherein reject heat is transferred from said refrigeration subsystem condenser element to said evaporative cooler subsystem flow to cooling water.

4. The hybrid air conditioning system defined by claim 3 wherein said refrigeration subsystem further has an absorption refrigeration cycle absorber element, and wherein reject heat also is transferred form said refrigeration subsystem absorber element to said evaporative cooler subsystem flow of cooling water.

* * * * *